US012398493B2

(12) United States Patent
Owens, Jr. et al.

(10) Patent No.: US 12,398,493 B2
(45) Date of Patent: Aug. 26, 2025

(54) FUNCTIONAL BRAIDED COMPOSITE YARN

(71) Applicant: Nautilus Defense LLC, Pawtucket, RI (US)

(72) Inventors: James B. Owens, Jr., Lincoln, RI (US); Zane A. Lewis, Foster, RI (US); Patrick M. Wynn, Cranston, RI (US)

(73) Assignee: NAUTILUS DEFENSE LLC, Pawtucket, RI (US)

( * ) Notice: Subject to any disclaimer, the term of this patent is extended or adjusted under 35 U.S.C. 154(b) by 680 days.

(21) Appl. No.: 17/413,478

(22) PCT Filed: Dec. 13, 2019

(86) PCT No.: PCT/US2019/066327

§ 371 (c)(1),
(2) Date: Jun. 11, 2021

(87) PCT Pub. No.: WO2020/131634

PCT Pub. Date: Jun. 25, 2020

(65) Prior Publication Data

US 2022/0056619 A1 Feb. 24, 2022

Related U.S. Application Data

(60) Provisional application No. 62/780,687, filed on Dec. 17, 2018.

(51) Int. Cl.
*D02G 3/44* (2006.01)
*D02G 3/04* (2006.01)
(Continued)

(52) U.S. Cl.
CPC ..... *D02G 3/441* (2013.01); *D02G 3/04* (2013.01); *D02G 3/12* (2013.01); *D02G 3/36* (2013.01);
(Continued)

(58) Field of Classification Search
CPC .. D02G 3/04; D02G 3/12; D02G 3/36; D02G 3/38; D02G 3/441; D04C 1/02; D03D 1/0088
See application file for complete search history.

(56) References Cited

U.S. PATENT DOCUMENTS 2,114,496 A 4/1938 Keating
3,014,087 A * 12/1961 Kaplan ..... H01B 7/06 87/2
(Continued)

FOREIGN PATENT DOCUMENTS

DE 69732664 T2 4/2005
DE 102006051001 A1 4/2008
(Continued)

OTHER PUBLICATIONS

"DuPont(TM) Kevlar(R) 49 Aramid Fiber", http://www.matweb.com/search/datasheet.aspx?MatGUID=77b5205f0dcc43bb8cbe6fee7d36cbb5&ckck=1, Downloaded Dec. 8, 2021.
(Continued)

*Primary Examiner* — Shaun R Hurley
(74) *Attorney, Agent, or Firm* — Philip D. Askenazy; Peacock Law P.C.

(57) ABSTRACT

Braided composite yarns including one or more functional components such as conductors and one or more structural components such as para-aramid fibers, and methods of manufacture therefor. Bundles of at least one functional component and at least one structural component undergo simultaneous parallel winding under tension onto a single bobbin prior to braiding, thus reducing the mechanical loading forces on the functional components in the final yarn. The yarns can be engineered with application-specific electrical, electronic, electromagnetic, or physical properties that enable their use as electronic components or sensors,
(Continued)

and attached to or incorporated into active textiles and composite substrates. The yarns can be directly soldered to without prior removal of insulation or other yarn components. Some yarns, such as those for use as inductors, can include a core with desired electrical properties.

36 Claims, 8 Drawing Sheets

(51) Int. Cl.

| | |
|---|---|
| ***D02G 3/12*** | (2006.01) |
| ***D02G 3/36*** | (2006.01) |
| ***D02G 3/38*** | (2006.01) |
| ***D03D 1/00*** | (2006.01) |
| ***D04C 1/02*** | (2006.01) |

(52) U.S. Cl.
CPC ..... *D02G 3/38* (2013.01); *D03D 1/0088* (2013.01); *D04C 1/02* (2013.01)

(56) References Cited

U.S. PATENT DOCUMENTS

| | | | | |
|---|---|---|---|---|
| 4,819,914 | A | 4/1989 | Moore | |
| 4,973,029 | A | 11/1990 | Robbins | |
| 5,036,166 | A | 7/1991 | Monopoli | |
| 5,058,818 | A * | 10/1991 | Haehnel | B65H 54/70 242/472.8 |
| 5,392,683 | A | 2/1995 | Farley | |
| 5,741,332 | A | 4/1998 | Schmitt | |
| 5,809,861 | A | 9/1998 | Hummel | |
| 5,901,632 | A | 5/1999 | Ryan | |
| 5,906,004 | A | 5/1999 | Lebby et al. | |
| 5,931,076 | A | 8/1999 | Ryan | |
| 6,210,771 | B1 | 4/2001 | Post et al. | |
| 6,341,550 | B1 | 1/2002 | White | |
| 6,727,197 | B1 | 4/2004 | Wilson et al. | |
| 7,240,599 | B2 * | 7/2007 | Nolan | H01B 5/104 87/8 |
| 7,516,605 | B2 | 4/2009 | Goldwater et al. | |
| 7,576,286 | B2 | 8/2009 | Chen | |
| 7,770,837 | B1 | 8/2010 | Head et al. | |
| 7,954,746 | B1 | 6/2011 | Head et al. | |
| 8,555,472 | B2 | 10/2013 | Cavallaro | |
| 8,859,088 | B2 | 10/2014 | Broughton et al. | |
| 8,918,970 | B2 | 12/2014 | Hayse | |
| 9,181,642 | B2 | 11/2015 | Cahuzac | |
| 9,433,489 | B2 | 9/2016 | Reilly et al. | |
| 9,481,948 | B2 | 11/2016 | Branscomb et al. | |
| 9,745,679 | B2 | 8/2017 | Zhang et al. | |
| 10,182,760 | B2 | 1/2019 | Nicoletti et al. | |
| 10,487,423 | B2 | 11/2019 | Riethmüller et al. | |
| 10,555,581 | B2 | 2/2020 | Bruce et al. | |
| 10,557,220 | B2 | 2/2020 | Fu et al. | |
| 11,873,590 | B1 | 1/2024 | Williams | |
| 2003/0056599 | A1 | 3/2003 | Van et al. | |
| 2003/0205041 | A1 | 11/2003 | Baker | |
| 2005/0082083 | A1 | 4/2005 | Nolan | |
| 2005/0229770 | A1 | 10/2005 | Smeets et al. | |
| 2006/0148355 | A1 | 7/2006 | Davis et al. | |
| 2006/0211934 | A1 | 9/2006 | Hassonjee et al. | |
| 2008/0091097 | A1 | 4/2008 | Linti et al. | |
| 2009/0176427 | A1 | 7/2009 | Hansen et al. | |
| 2010/0229456 | A1 | 9/2010 | Nakanishi | |
| 2012/0108699 | A1 | 5/2012 | Fang et al. | |
| 2014/0157974 | A1 | 6/2014 | Cahuzac | |
| 2014/0172096 | A1 | 6/2014 | Koob et al. | |
| 2014/0377488 | A1 | 12/2014 | Jamison | |
| 2016/0284436 | A1 | 9/2016 | Fukuhara et al. | |
| 2016/0326675 | A1 | 11/2016 | Kinugasa | |
| 2017/0035149 | A1 | 2/2017 | Bruce et al. | |
| 2017/0107647 | A1 | 4/2017 | Riethmüller et al. | |
| 2017/0232538 | A1 | 8/2017 | Robinson et al. | |
| 2017/0233903 | A1 | 8/2017 | Jeon | |
| 2018/0087191 | A1 | 3/2018 | Threlkeld | |
| 2018/0087193 | A1 | 3/2018 | Fu et al. | |
| 2018/0255639 | A1 | 9/2018 | Bergman et al. | |
| 2018/0363175 | A1 | 12/2018 | Bayraktar | |
| 2019/0021407 | A1 | 1/2019 | Howland | |
| 2019/0062951 | A1 | 2/2019 | Rizk et al. | |
| 2019/0079582 | A1 * | 3/2019 | Lyons | G06F 3/017 |
| 2019/0327832 | A1 | 10/2019 | Holbery et al. | |
| 2020/0125195 | A1 | 4/2020 | Tremmel et al. | |
| 2020/0270775 | A1 | 8/2020 | Oppenheim | |
| 2021/0008815 | A1 | 1/2021 | Huoponen et al. | |
| 2021/0206481 | A1 | 7/2021 | Brion et al. | |

FOREIGN PATENT DOCUMENTS

| | | | |
|---|---|---|---|
| DE | 102017123922 | A1 | 4/2019 |
| EP | 0290977 | A1 | 11/1988 |
| EP | 0482489 | A1 | 4/1992 |
| EP | 1537264 | B1 | 5/2006 |
| FR | 2625599 | A1 | 7/1989 |
| FR | 2755577 | A1 | 5/1998 |
| JP | 4174 | | 3/1939 |
| JP | H01300834 | A | 12/1989 |
| JP | H0623558 | U | 3/1994 |
| JP | H10168699 | A | 6/1998 |
| JP | 2004115995 | A | 4/2004 |
| JP | 3111295 | U * | 7/2005 |
| JP | 2006198939 | A | 8/2006 |
| JP | 2013144009 | A | 7/2013 |
| JP | 2014070286 | A | 4/2014 |
| JP | 2019112862 | A | 7/2019 |
| KR | 820001435 | B1 | 8/1982 |
| KR | 101015563 | B1 | 2/2011 |
| KR | 10-2011-0083435 | | 7/2011 |
| KR | 20120010028 | A | 2/2012 |
| KR | 10-2017-0049599 | | 5/2017 |
| KR | 20170130534 | A | 11/2017 |
| RU | 2569839 | C1 | 11/2015 |
| WO | 9820505 | A1 | 5/1998 |
| WO | 2010058360 | | 5/2010 |
| WO | 2013000995 | A1 | 1/2013 |
| WO | 2014135850 | | 9/2014 |
| WO | 2019143694 | A1 | 7/2019 |

OTHER PUBLICATIONS

Adumitroaie, Adi , et al., "Stiffness and strength prediction for plain weave textile reinforced composites", Mechanics of Advanced Materials and Structures, vol. 19, 2012, 169-183.

Allaoui, S. , et al., "Mechanical and electrical properties of a MWNT/epoxy composite", Composites Science and Technology, vol. 62, 2002, 1993-1998.

Cheng, M. , et al., "Experimental investigation of the transverse mechanical properties of a single Kevlar(R) KM2 fiber", International Journal of Solids and Structures, vol. 41, 2004, 6215-6232.

English, S A., et al., "A micro to macro approach to polymer matrix composites damage modeling", Sandia Report SAND2013-10666, Dec. 2013.

English, S. , et al., "Material Characterization with Representative Volume Simulations of Woven Polymer Matrix Composites", The 19th International Conference on Composite Materials, 2013.

Li, S. , et al., "Boundary conditions for unit cells from periodic microstructures and their implications", Composites Science and Technology, vol. 68, 2008.

Nayak, S. , et al., "A microstructure-guided numerical approach to evaluate strain sensing and damage detection ability of random heterogeneous sel-sensing structural materials", Computational Materials Science, vol. 156, 2019, 195-205.

Potluri, P. , et al., "Developments in Braided Fabrics", Specialist yarn and fabric structures. Developments and Applications, ed. R.H. Gong, Woodward Publishing Ltd., United Kingdom, 2011, 333-353.

Tang, X. , et al., "Progressive Failure Behaviors of 2D Woven Composites", Journal of Composite Materials, vol. 37, 2003, 1239-1259.

(56) References Cited

OTHER PUBLICATIONS

Wang, L. , et al., "Progressive failure analysis of 2D woven composites at the meso-micro scale", Composite Structures, vol. 178, 2017, 395-405.
Xia, Z. , et al., "On selection of repeated unit cell model and application of unified periodic boundary conditions in micro-mechanical analysis of composites", International Journal of Solids and Structures, vol. 43, 2006, 266-278.
Patel, et al., "Applications of electrically conductive yarns in technical textiles", 2012 IEEE International Conference on Power System Technology (POWERCON), Auckland, New Zealand, 2012, 1-6.
Zhao, et al., "3D braided yarns to create electrochemical cells", Electrochemistry Communications, vol. 61, 2015, 27-31.

* cited by examiner

FUNCTIONAL BRAIDED COMPOSITE YARN

CROSS-REFERENCE TO RELATED APPLICATIONS

This application claims priority to and the benefit of the filing of U.S. Provisional Patent Application No. 62/780,687, filed Dec. 17, 2018, which is incorporated by reference in its entirety.

BACKGROUND OF THE INVENTION

Field of the Invention (Technical Field)

The present invention relates generally to braided composite yarns or threads, including conductive yarns or threads, that for example can be used in the construction of textile-integrated electronic systems (TIES). The braided composite yarns and threads of the present invention enable the integration of traditional electrical and electronic elements into textiles. They are compatible with sewing, embroidery, tailored fiber placement, and weaving and meet or exceed the operational requirements of both traditional and technical textiles and textile systems.

Background Art

Note that the following discussion may refer to a number of publications and references. Discussion of such publications herein is given for more complete background of the scientific principles and is not to be construed as an admission that such publications are prior art for patentability determination purposes.

SUMMARY OF THE INVENTION (DISCLOSURE OF THE INVENTION)

An embodiment of the present invention is a braided composite yarn comprising one or more multicomponent fiber bundles, each one or more multicomponent fiber bundle comprising one or more functional components and at least one structural component. At least one of the one or more functional components preferably comprises a conductor and the conductor is preferably insulated. The conductor preferably comprises 44AWG copper wire insulated with layered polyurethane and/or polyamide insulation. The conductor optionally comprises a material with a sufficiently high resistivity and sufficiently low temperature coefficient of resistance to be suitable for resistive joule heating. At least one of the one or more functional components preferably comprises a material selected from the group consisting of plastic, glass, fiber optic material, nickel-titanium alloy, nickel-chrome alloy, extruded conductive polymer, conductive yarn, and piezoelectric yarn. The material optionally comprises an additive, coating, or plating to modify its electrical, mechanical, optical, surface, visual, or other properties. The at least one structural component preferably comprises a material selected from the group consisting of synthetic, natural, bonded para-aramid, meta-aramid, silica, quartz, nylon, polyester, cotton, and wool. The diameter of the at least one structural component is preferably at least approximately twice a diameter of the one or more functional components. The maximum elongation at break of the at least one structural component is preferably less than an elastic limit of the one or more functional components, preferably approximately less than 10%. The at least one structural component preferably flattens when the braided composite yarn is under tension. The one or more multicomponent fiber bundles are optionally braided together with additional structural components. The one or more functional components are preferably accessible at the surface of the braided composite yarn. The braided composite yarn is optionally configured to form at least a portion of one or more electronic or electromagnetic devices, and each device is preferably selected from the group consisting of inductor, capacitor, antenna, collapsible antenna structure, transmission line, inter-integrated circuit ($I^2C$) network, data network, serial data bus, ethernet network, power network, active heating element, power line, electromagnet, choke, transformer, sensor, capacitive touch sensor, strain sensor, distributed sensor network, sensor array, and filter. The one or more functional components of one of the one or more multicomponent fiber bundles optionally comprise two conductors which form a twisted pair transmission line. The braided composite yarn optionally comprises core, which preferably has one or more properties selected from the group consisting of solid, hollow, conducting, dielectric, insulating, ferromagnetic, superelastic, shape memory, and para-aramid. The core preferably limits deformation of the braided composite yarn under tension.

Another embodiment of the present invention a method of using the braided composite yarn of claim 1, the method comprising incorporating the braided composite yarn into an active textile. The method optionally comprises sewing the braided composite yarn onto the active textile. The sewing step preferably comprises attaching the yarn to the active textile using straight sewn stitches of a top thread, which preferably comprises a spun or multifilament thread, preferably a meta-aramid thread. The stitches preferably periodic, thereby forming mechanically isolated subdomains of the yarn. Adjacent stitches are preferably spaced approximately between 1 mm and 2 mm. The braided composite yarn is preferably loaded in the bobbin of a sewing or embroidery machine. The method alternatively comprises weaving the yarn into the warp or weft of the active textile. The method optionally comprises directly soldering the braided composite yarn to an electronic component or printed circuit board through-hole attached to the active textile, in which case the insulation is removed from at least one of the one or more functional components preferably using heat from a soldering device, without requiring stripping the insulation prior to soldering. The at least one structural component preferably has a higher decomposition temperature than a soldering temperature. The method preferably comprises encapsulating the electronic component directly to the active textile using epoxy potting compound, and preferably comprises routing the braided composite yarn using computer aided design (CAD), whereby the incorporating step comprises CNC embroidery, tailored fiber placement, or using a CNC machine.

Another embodiment of the present claims is a method of manufacturing a braided composite yarn, the method comprising winding in parallel one or more functional components and at least one structural component to form a first multicomponent fiber bundle; and braiding the first multicomponent fiber bundle with a second multicomponent fiber bundle and/or a structural component. The winding step preferably comprises winding the multicomponent fiber bundle onto a single braider bobbin. The winding step is preferably performed under tension. The braiding step optionally comprises loading a first braider bobbin comprising the first multicomponent fiber bundle and a second braider bobbin comprising a second multicomponent fiber bundle or a structural component in a braiding machine in a balanced quarter-carrier configuration. The braiding step preferably comprises using a braiding machine selected from the group consisting of rotary, lace, square, radial, biaxial, triaxial, two-dimensional, and three-dimensional. The braiding step optionally comprises incorporating a core in the braided composite yarn. The braiding step preferably comprises selecting a take-up rate of a braiding machine relative to a rotational rate of braider bobbin carriers and using one or more guide rings.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate the practice of embodiments of the present invention and, together with the description, serve to explain the principles of the invention. The drawings are only for the purpose of illustrating certain embodiments of the invention and are not to be construed as limiting the invention. In the drawings.

DETAILED DESCRIPTION OF EMBODIMENTS OF THE INVENTION

Figure 1A:
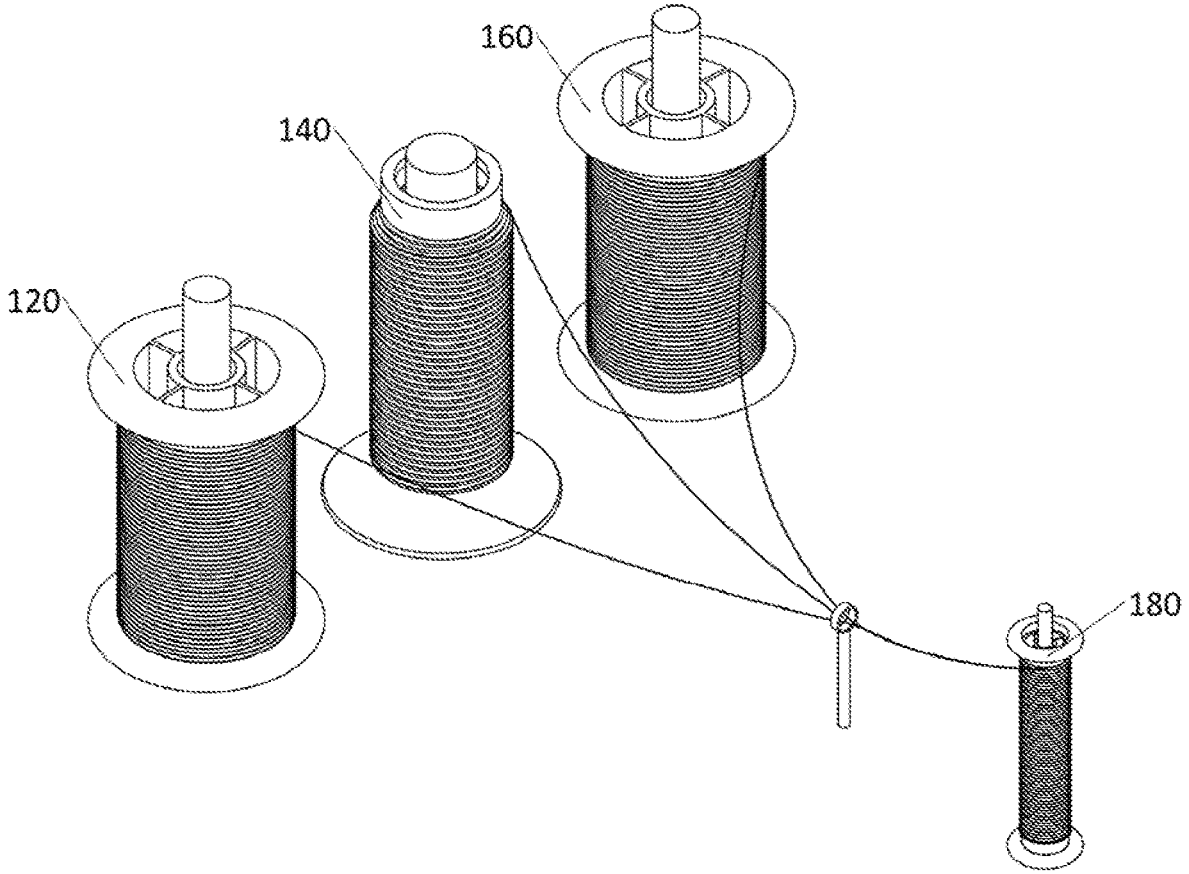
FIG. 1A illustrates a method of simultaneous parallel winding of a multicomponent fiber bundle of the present invention.

One or more embodiments of the present invention are preferably braided composite yarns and threads and methods of manufacture thereof, including the simultaneous parallel winding of one or more conductors and one or more structural yarns onto one or more bobbins, and loading the bobbins into a braiding machine to produce a coreless thread construction with mechanically captive conductors. Advantages of some embodiments of the present invention are: direct manipulation of individual conductors is unnecessary due to the high conductor content of the yarns or threads by volume, which enables direct soldering and the formation of mechanically and electrically sound solder joints; local removal of the conductors' insulation can be accomplished by the application of heat during the soldering process, allowing for the construction of textile integrated electronic systems with fully encapsulated routes; compatibility with both flexible and rigid PCB's with through-hole attachments; high mechanical and electrical reliability during high-rate manufacturing operations and during use; and compatibility with integrated electromagnetic structures, including twisted pair transmission lines, air and ferromagnetic-cored inductors, capacitors, and antennas.

As used throughout the specification and claims, the term "yarn" means yarn or thread. As used throughout the specification and claims, the term "structural", referring to a component fiber of a yarn, means load-bearing and providing mechanical structure and stability. As used throughout the specification and claims, the term "functional", referring to a component fiber of a yarn, means providing an electrical, electronic, optical, electromagnetic, sensing, heating, actuating, chemical, or physical function, and the like. As used throughout the specification and claims, the term "composite" means comprising both structural and functional components. As used throughout the specification and claims, the term "multicomponent fiber bundle" means one or more functional components and at least one structural component that are co-wound in parallel together on a bobbin prior to braiding. As used throughout the specification and claims, the term "active textile" means electrically active textile, electrically functional textile, e-textile, smart textile, textile integrated electronic system (TIES), soft system, functionalized soft system, composite system, structure-integrated system, smart textile, garment, and the like.

The braided composite yarns of the present invention allow for the selective location and interconnection of electronic devices across a surface area of a textile, enabling the development of functionalized soft and composite systems, for example smart textiles, composites with integrated structural health monitoring, or other devices that integrate traditional electrical, electronic, and electromagnetic capabilities directly into the construction of materials used traditionally for only mechanical purposes, suitable for mission-critical operations. By minimizing the textile integration costs and associated capability detractors incurred with the addition of electronic capabilities, the braided composite yarns allow for the exploration and development of a broad range of distributed soft and structure-integrated systems. Promising capabilities enabled by these braided composite yarns include distributed sensor networks, collapsible antenna structures, structure-integrated data and power networks, structure-integrated active heating, and broad area conformal sensor arrays.

The braided composite yarns of the present invention are preferably engineered to strike a balance between the disparate requirements of textile and electronic systems without adversely impacting the system's textile or electrical performance characteristics. They are preferably compatible with traditional textile and electronic manufacturing methods and machinery, enabling their application at scale.

Figure 1B:
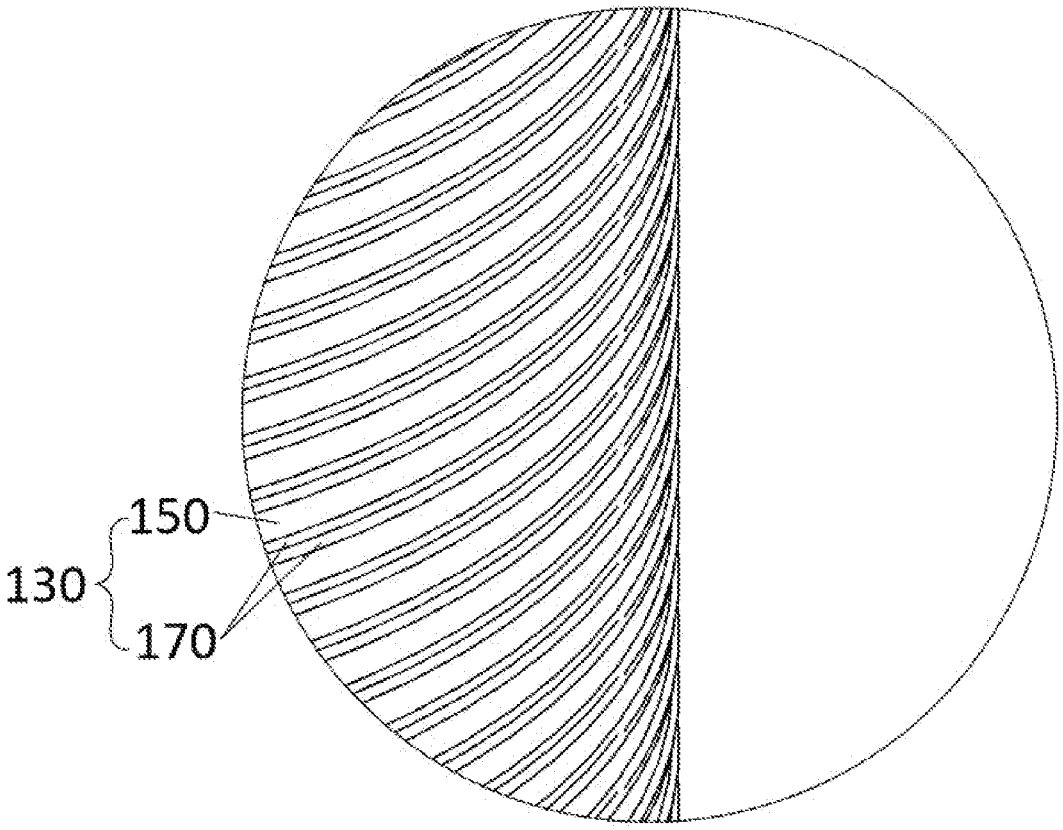
FIG. 1B shows a closeup of the multicomponent fiber bundle of FIG. 1A wound on a braider bobbin.

As shown in FIG. 1A, an embodiment of a multicomponent fiber bundle of the present invention is manufactured as follows. Functional components, for example insulated copper wire (preferably 44AWG) are wound on spools 120, 160. Center spool 140 is wound with a structural component, for example bonded Tex 21 para-aramid (Kevlar®) yarn. Functional components from spools 120, 160 and structural component from spool 140 are preferably simultaneously co-wound in parallel onto a single braider bobbin 180, preferably using a parallel winding machine, to form continuous multicomponent fiber bundle 130, shown in the close up of braider bobbin 180 in FIG. 1B. The parallel co-winding is preferably performed under tension, and multicomponent fiber bundle 130 remains in tension on braider bobbin 180, so that the functional components in the multicomponent fiber bundle do not separate from the structural components in subsequent manufacturing steps. In the embodiment shown in FIGS. 1A-1B, multicomponent fiber bundle 130 comprises two functional components 170 and one structural component 150. However, a multicomponent fiber bundle may comprise any number of functional components and any number of structural components. Multiple discrete conductors provide redundancy for greater systems reliability and increased current carrying capacity. The simultaneous parallel winding of the conductors and para-aramid yarns to form a multicomponent fiber bundle prior to the braiding process reduces the twist and resultant stresses the conductors are exposed to, both during and after manufacture.

Figure 2:
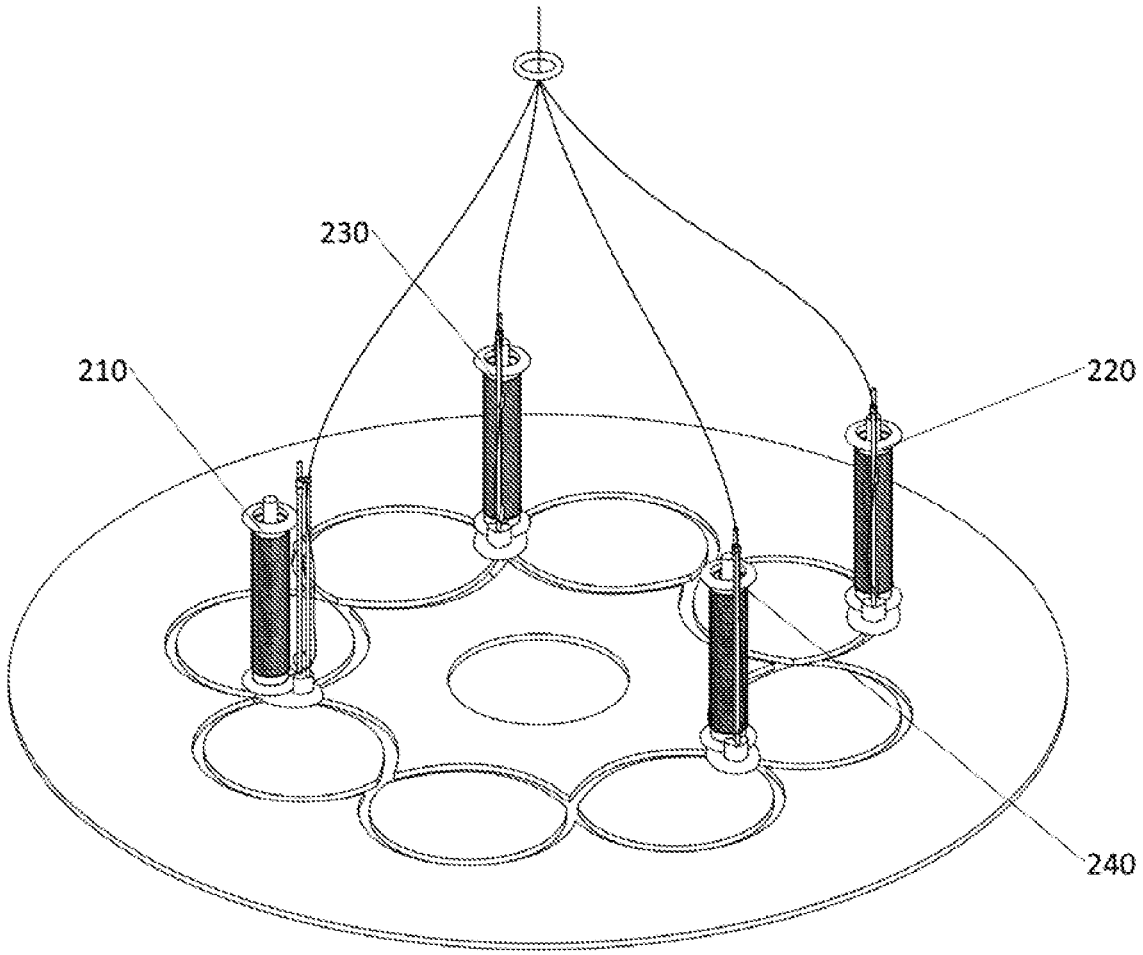
FIG. 2 illustrates a method of braiding a braided composite yarn of the present invention.

As shown in FIG. 2, in one embodiment four braider bobbins 210, 220, 230, 240 are prepared in a similar manner, after which they are preferably loaded into a maypole braiding machine in a balanced quarter-carrier configuration such that bobbins 210, 220 are traveling clockwise and bobbins 230, 240 are traveling counterclockwise in a serpentine motion. The braider then forms a helically intertwined yarn structure with mechanically captive functional components and with minimal twist and a small braid angle, preferably without the use of a core or mandrel. Any number of such braider bobbins may be used, and the braider bobbins may comprise the same or different multicomponent fiber bundles. One or more other optional bobbins comprising only structural materials may optionally be additional loaded on the braiding machine as required to braid a yarn with the desired thread size and construction. Although this configuration produces a biaxial or two-dimensional (2D) braid, embodiments of the present invention can be manufactured on a triaxial or three-dimensional (3D) braiding machine.

The resultant braided composite yarn provides inherent strain relief to the embedded functional components by limiting their range of motion within the yarn's construction. The braid kinematics of these yarns are such that their diameter decreases when under tension, applying compressive forces perpendicular to the longitudinal axis of the multicomponent fiber bundles. This contributes to the structural components serving as the principal load-bearing components, protecting the functional components from undesirable loading and damage. The functional materials are preferably held captive to the structural members, enabling a stable construction which is mechanically consistent through textile manufacturing processes and in use. The ratio of structural components to functional components can be varied to tailor the mechanical or electrical characteristics of the yarns as required for the intended application.

Also contributing to the mechanical protection of the functional materials contained within the braided composite yarns of the present invention is the selection of structural components, which are preferably at least twice the diameter of the incorporated functional components. This aids in protecting the functional components from abrasion and bend radii that could lead to fracturing. The maximum elongation of the structural components before failure is preferably less than the elastic limit of the functional components, thus ensuring that the braided composite yarn will not fail due to deformation or fatigue and subsequent degradation of the functional components. The structural components therefore serve as the yarn's principal load-bearing components, protecting the conductors or other functional components from undesirable stress and damage. This feature, combined with the kinematics of the braided structure, ensures that the functional materials will not experience plastic deformation or failure while the braided composite yarn is under tension. These features preferably enable a stable construction which is mechanically consistent through textile manufacturing processes including sewing, embroidery, and weaving, as well as during operational use.

When possible, bonded yarns or yarns constructed from a plurality of continuous filaments are preferable for use as the structural components in the composite braided yarns of the present invention. However, the structural components can comprise any material required to achieve the desired mechanical properties for the application of interest. Many of these materials such, as para-aramids, have an elongation at break of less than 10% because of their molecular crystallinity and structural continuity. A bonding agent applied to the surface of the twisted continuous filaments within the structural components ensures that the structural components maintain a uniform geometry during manufacturing. This does not significantly restrict the material's ability to flatten or otherwise deform when the braided composite yarn is under tension, which contributes to the ability of the structural components to restrict the movement of the functional components without imparting strain to the functional components. This effect is also aided by the parallel integration of the functional materials along the length of the structural materials within each multicomponent fiber bundle.

The braided composite yarns of the present invention are preferably coreless to reduce their diameter, enabling applications that can't be addressed with existing conductive yarns. In addition, unlike existing yarns in which the conductor is at the core, the braided composite yarns of the present invention enable direct access to the functional materials, for example conductors, for interconnection at the exterior of the yarn.

The braided composite yarns of the present invention may be engineered for a variety of applications through selection of their functional and structural materials and varying the content ratio of the materials. For example, some embodiments of the present invention are engineered for the transmission and reception of data and power, enabling the construction of textile-integrated electrical systems. For this application the yarn preferably comprises discrete 44AWG copper, copper alloy, or copper-plated conductors with layered polyurethane and polyamide insulation, and bonded Tex 21 para-aramid yarns. Beyond textile-integrated data and power networks, by utilizing other functional materials and structures, such as alloys engineered to exhibit a low temperature coefficient of resistance (such as Nichrome) or superelasticity (such as Nitinol), the yarns can be used for applications such as heating, actuation and sensing. Different structural materials may be selected to achieve the desired mechanical characteristics of the yarn to be produced.

Braided composite yarns of the present invention are preferably functional as continuous yarns and can be selectively integrated directly into the warp or weft of a woven fabric during construction. These functionalized woven fabrics can be used in the construction of garments, rigid composites, flexible composites, or any other system which incorporates a woven textile and where additional electrical, electronic, or electromagnetic capabilities provide value. Similarly, braided composite yarns can be incorporated as members of larger braided constructions for use in the construction of flexible and rigid composite materials.

Braided composite yarns can be designed with integrated electromagnetic and electronic structures by selectively incorporating functional materials fiber processing paths within the braid. The geometry of these fiber paths can be varied through modifying the diameter of the core material incorporated (if used), the diameter and quantity of the structural components, the take-up rate of the braider relative to the rotational rate of the carriers, the use of, quantity, diameter, and position of guide rings, and the angle at which the braided multicomponent fiber bundles interlace. The quantity and type of functional materials can then be selected to create braided composite yarns with engineered electromagnetic and electronic structures, including inductors, capacitors, antennas, and transmission lines. Braided composite yarns of the present invention can also be connected electrically in parallel, leveraging the surface area of a textile to further distribute and increase the current-carrying capacity of integrated textile circuits.

The routes which the braided composite yarns take on a textile, forming for example the integrated textile data and power networks, and interconnection locations thereon may be designed using computer aided design (CAD). These designs are then preferably imported into digitizing software, where the proper stitches and sequencing are configured for each route and translated into a file format used by CNC embroidery, tailored fiber placement, or CNC machines. Preferably only traditional straight stitches are employed to create these routes, enabling commercially available large-format CNC sewing and quilting machines to be employed in their construction. In addition, the braided composite yarns of the present invention are secured preferably using only traditional straight sewn stitches without the need for creating any three-dimensional stitches. The sewn stitch construction employed also preferably aids in mechanical stitch-to-stitch isolation by forming mechanical subdomains along the length of the integrated braided composite yarn. This benefit is also observed when incorporating braided composite yarns into woven fabrics.

Soldering is the preferred method of forming reliable, permanent electromechanical interconnections. The braided composite yarns of the present invention can be soldered directly to electronic components using both traditional and application-specific interconnection methods. This is preferably enabled by the conductor content of the yarn, the high decomposition temperature of structural materials such as para-aramid, and the conductors' polymeric insulation, which is removable with the application of heat, thereby eliminating the need for a secondary mechanical or chemical stripping process to gain access to the conductors. The construction of the braided composite yarns also enables access to the conductors at their exterior for reliable interconnections with low gap distance between the conductors and the electronic components to be soldered to, unlike typical solderable conductive yarns that incorporate the conductors at their core or below layers that require removal. The high wetting capability and low surface tension of typical solder allows it to flow and conform to the conductors incorporated within the braided composite yarns.

Braided composite yarns can be soldered directly to traditional PCB through-holes to form solder joints with integrated mechanical strain relief. Although many different methods for such soldering may be used, in one embodiment, a loop of braided composite yarn is formed at the desired connection location through stitching or other mechanical means. This loop is inserted into the PCB through the hole to which the yarn is to be connected. A piece of solderable material, such as tinned copper wire or copper braid, is passed through the loop and preferably tied to the loop to aid thermal transfer to all conductors contained within the braided composite yarn. Any remaining slack is preferably removed from the loop to limit its movement. The materials to be interconnected are then heated to the solder melting point, typically 376 degrees Celsius. Solder flows at the joint to create a local solder bath, preferably contacting all conductors present at the interconnection location. Finally, the heat source is removed and the joint is allowed to cool and solidify before being subjected to motion.

The methods employed to design and produce systems using the braided composite yarns of the present invention allow for the selective location and interconnection of electronic devices across the surface area of the TIES textile, enabling the development of functionalized soft systems suitable for mission operations. By minimizing the textile integration costs and associated capability detractors incurred with the addition of electronic capabilities, these methods allow for the exploration and development of a broad range of distributed soft systems, such as garment and structure-integrated distributed sensor networks, physiological monitoring systems, actuator networks, collapsible antenna structures, data and power networks, active heating, and broad area conformal sensor arrays. All yarns and threads are preferably constructed using domestically manufactured materials and preferably are fully Berry compliant.

The braided composite yarns of the present invention enable the integration of traditional electrical, electronic, and electromagnetic elements into textiles using methods and materials which minimally impact the textile substrate's operational performance and maintainability, can be used in textile-integrated power distribution networks, can form directly soldered interconnections to traditional electronic components without mechanical degradation or secondary processes, can be used as textile-integrated inter-integrated circuit ($I^2C$), SPI, and USB2.0 (or higher) serial data buses and ethernet networks for device to device communications (which have been demonstrated at up to 50' using a single thread), can be used for textile-based capacitive touch inputs, can form textile-integrated antenna structures for wireless power and data transfer, can provide thread-based capacitance and strain sensing, can form textile-integrated heating networks, enable shielding and concealment of the yarns using seams, tapes, and lamination techniques, are compatible with textile-adhered local encapsulation of rigid components, enable the distributed, scalable integration of traditional electronic components into a flexible textile system, and are preferably engineered for use with traditional textile and electronics manufacturing and integration methods.

Systems of the present invention preferably have one or more of the following advantages: direct manipulation of individual conductors is unnecessary due to the conductor content by volume to allow for direct soldering (note that conductors are preferably grouped and terminated in pairs if using a single thread as a transmission line); solder joints are mechanically and electrically sound due to the strain relief provided by the structural components and the high conductor content of the yarns; local removal of the conductors' insulation is achieved through the application of heat during the soldering process, allowing for fully encapsulated routes; compatibility with both flexible and rigid PCB's with through-hole attachments; conductor mechanical loading is minimized through braided construction, low elongation of structural materials, and the relationship between the functional and structural materials' diameters; and enabling the manufacture of engineered electromagnetic structures including twisted pair transmission lines, air and ferromagnetic-cored inductors, capacitors (possibly incorporating a twisted core of fine PTFE-insulated wire, similar to a "gimmick" capacitor), and antennas.

TIES can be utilized to build rapidly deployable functional structures, distributed conformal sensor networks, and functionalized composite materials. Using a custom roll-to-roll CNC sewing machine these systems can be constructed at continuous length for a variety of applications. In addition to wherever textiles are traditionally employed, TIES can add novel capabilities to systems requiring mechanical strength, durability, and persistent flexibility, the ability to pack into a small volume, and the ability to rapidly and repeatedly change geometry and volume.

EXAMPLES

Example 1

Figure 3A:
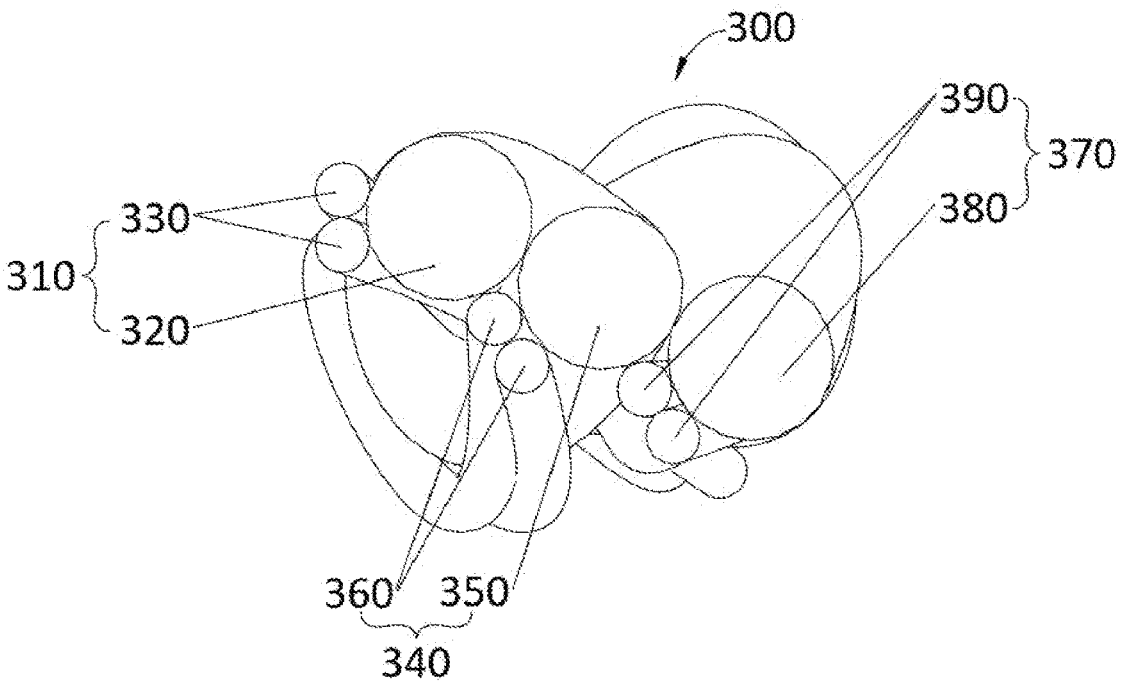
FIG. 3A is an end view of a braided composite yarn of the present invention.
Figure 3B:
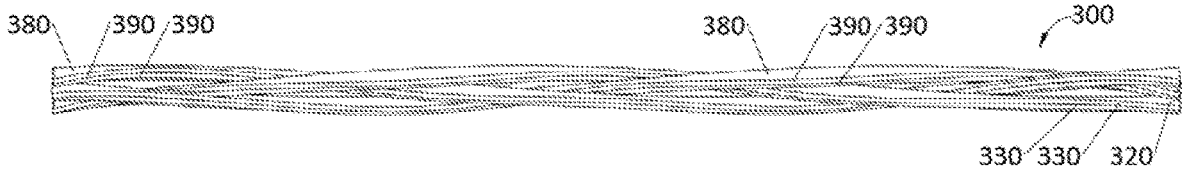
FIG. 3B is a top view of the braided composite yarn of FIG. 3A.

As shown in FIGS. 3A and 3B, braided composite yarn 300 of the present invention was braided from three multicomponent fiber bundles 310, 340, 370, each comprising two 44AWG copper conductors 330, 360, 390, respectively, insulated with layered polyurethane and polyamide insulation, as the functional components, and one Tex 21 bonded Kevlar® yarn 320, 350, 380, respectively, as the structural components.

Example 2

Figure 4A:
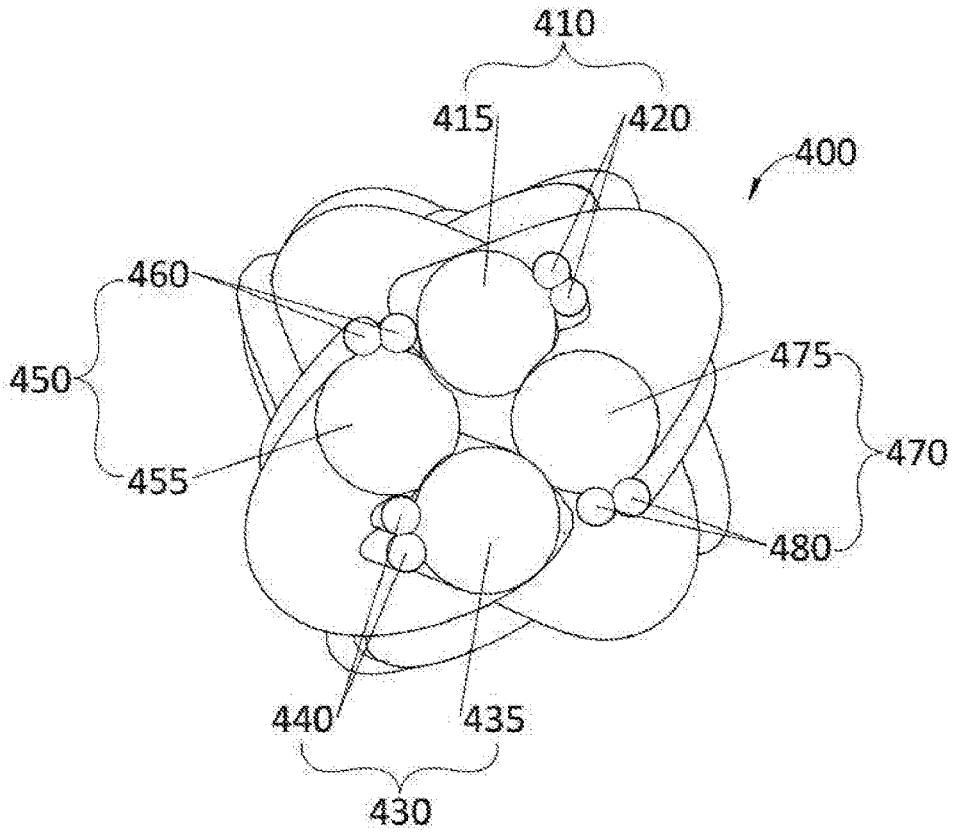
FIG. 4A is an end view of a braided composite yarn of the present invention.
Figure 4B:
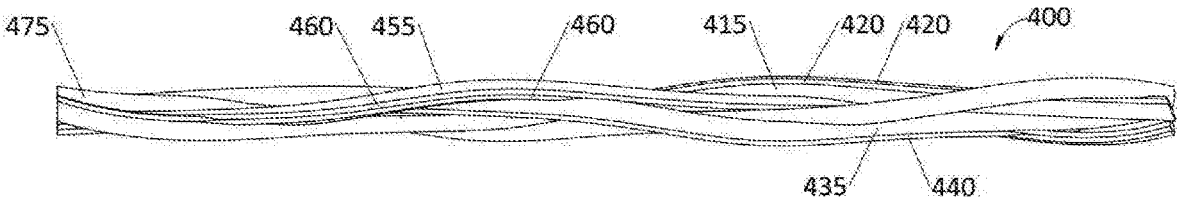
FIG. 4B is a top view of the braided composite yarn of FIG. 4A.

As shown in FIGS. 4A and 4B, braided composite yarn 400 of the present invention was braided from four multicomponent fiber bundles 410, 430, 450, 470, each comprising two 44AWG copper conductors 420, 440, 460, 480, respectively, insulated with layered polyurethane and polyamide insulation, as the functional components, and one Tex 21 bonded Kevlar® yarn 415, 435, 455, 475, respectively, as the structural components. This configuration forms two pairs of multiconductor twisted pairs, which can be used for differential signaling applications such as RS422 and Ethernet, or alternatively to form power and signal pairs in a single braided composite yarn. This configuration was capable of transmitting 10 mbps over 50 ft and 100 mpbs at 6 ft using a single yarn.

Example 3

Figure 5:
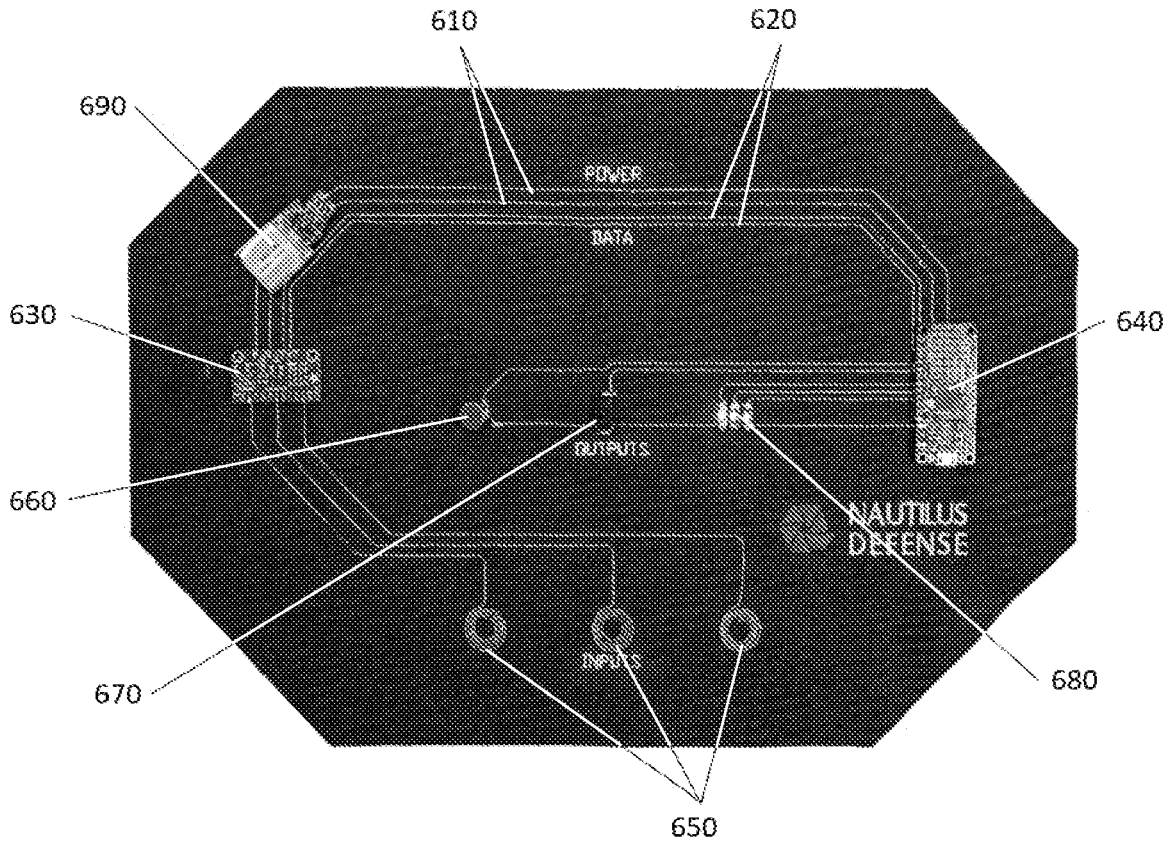
FIG. 5 is a photograph of braided composite yarns of the present invention routed and sewed to a TIES textile.
Figure 6:
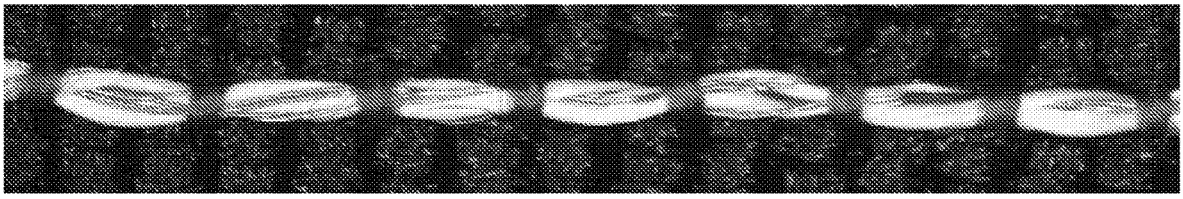
FIG. 6 is a closeup of FIG. 5 detailing the attachment of a braided composite yarn to the TIES textile.

FIG. 5 shows routes of straight stitch braided composite yarn of Example 2 applied to a 1000 denier Nylon Cordura® woven textile of a TIES prototype using a CNC embroidery machine. Tex 27 spun Nomex® meta-aramid thread was used as the top thread for its mechanical structure and performance. The spun construction enabled the thread to flatten when capturing the composite braid, distributing tension across a broader surface area than a bonded or monofilament thread would, thus preventing undue stress on the conductors in the composite braid. The braided composite yarn was loaded exclusively in the bobbin mechanism of the embroidery machine, which formed a series of loops interlaced with the top thread, to ensure the yarn underwent minimal strain during the manufacturing process. While the top thread typically experiences periods of compression when the needle is reversing direction, the braided composite yarn on the bobbin was always under tension, thus ensuring the formation of a reliable stick without any undesirable deformation to the functional components of the braided composite yarn. The braided composite yarns were used to form DC power lines 610 and inter-integrated circuit data networks 620 between two PCBs 630, 640. The yarns were also used as capacitive touch sensors 650 and to drive vibration motor 660, speaker 670, and LEDs 680. Battery 690 was also charged using power lines 610 when PCB 640 was connected to an external 5 VDC power source. Activation of each capacitive touch sensors operated the output device above that sensor for the duration of the touch for the left two capacitive touch sensors 650 and the vibration motor 660 and the speaker 670 respectively. Activation of the rightmost capacitive touch sensor 650 below LEDs 680 cycled through the sequential activation of one, two, three, and zero LEDs 680. All electronic components were soldered directly to the braided composite yarns. FIG. 6 shows a detail of the braided composite yarn sewn to the textile substrate of the TIES prototype using Tex 27 spun Nomex® thread.

Example 4

Figure 7:
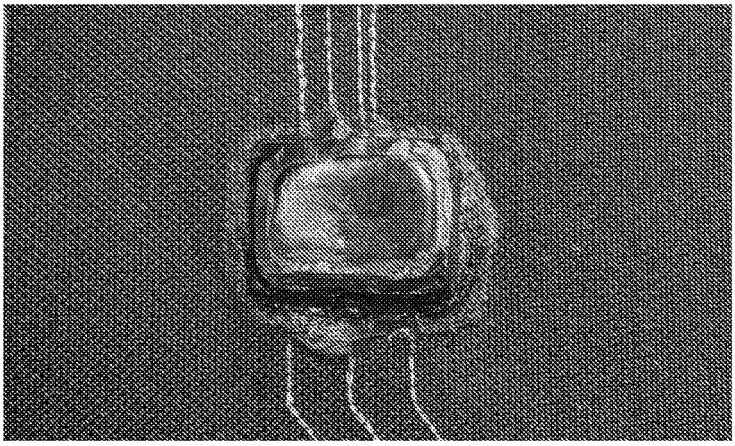
FIG. 7 is a photograph showing a printed circuit board (PCB) encapsulated directly to textile substrate using epoxy potting compound.

Environmental and physical protection of exposed electronic components and conductors is critical for the reliable fielding of systems. This can be achieved using conformal encapsulants such as epoxy potting compounds. Environmentally hardened enclosures can also be developed where access to the underlying electronics is of value to mission operations. FIG. 7 illustrates a PCB encapsulated directly to textile substrate using epoxy potting compound.

Example 5

Figure 8:
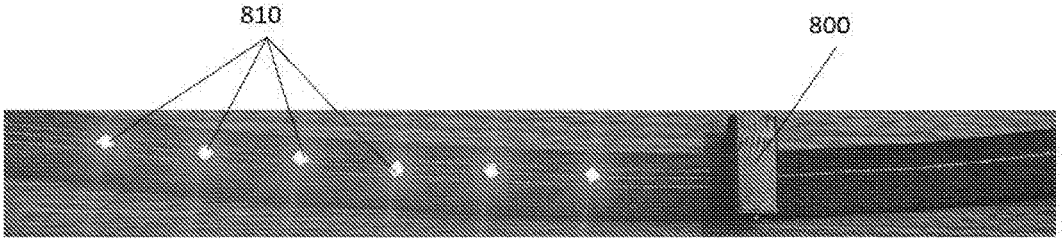
FIG. 8 is a photograph showing a woven textile comprising three braided composite yarns of the present invention woven in the weft of the fabric to form data, power, and ground lines for interconnection to discrete addressable light emitting diodes (LEDs).

As shown in FIG. 8, a woven textile was constructed comprising three braided composite yarns of Example 1 woven in the weft of the fabric. Terminating at the left side of the systems' electronics enclosure 800 are three braided composite yarns which form data, power, and ground lines for interconnection to discrete addressable red green blue (RGB) light emitting diodes (LEDs) 810. The braided composite yarn terminating at the right side of electronics enclosure 800 acts as a capacitive touch sensor, stepping LEDs 810 through a programmed color sequence with each touch. The upper and lower braided composite yarns woven into the weft that were originally present to the right of electronics enclosure 800 were cut and removed.

Example 6

Figure 9:
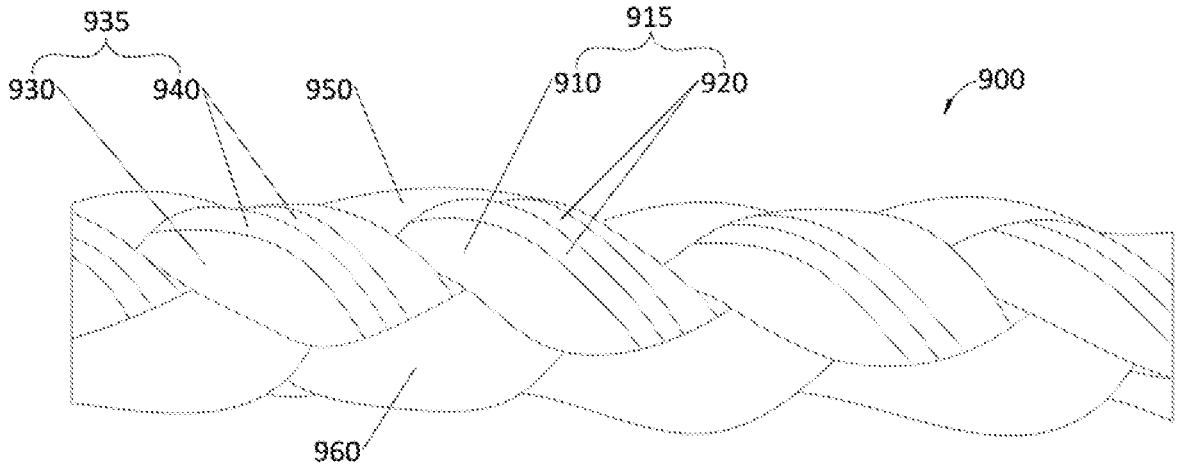
FIG. 9 shows a braided composite yarn of the present invention configured to form an inductor.

FIG. 9 shows a braided composite yarn of the present invention configured to form an inductor. Braided composite yarn 900 was braided from two Tex 21 bonded Kevlar® yarns 950, 960 and two multicomponent fiber bundles 915, 935, each multicomponent fiber bundle comprising two 44AWG copper conductors 920, 940, respectively, insulated with layered polyurethane and polyamide insulation, as the functional components, and one Tex 21 bonded Kevlar® yarn 910, 930, respectively, as the structural components, all braided over a core (not shown). Some of the yarns comprised a Tex 21 bonded Kevlar® yarn as the core, and some comprised a Permalloy (ferromagnetic) core. The size and material of the core was chosen to produce desired electromagnetic properties of the inductor and achieve the desired diameter of the braid. During construction, the two braider bobbins containing multicomponent fiber bundles 915, 935 traveled clockwise, while the two braider bobbins containing Kevlar® yarns 950, 960 traveled counterclockwise. The braid angle in this example is higher than those in Examples 1 and 2 in order to form a tighter coil, which increases the turns per length of the conductors, thereby increasing inductance. The core helped to stabilize the high braid angle yarn, which otherwise would change shape significantly under tension.

Example 7

Figure 10:
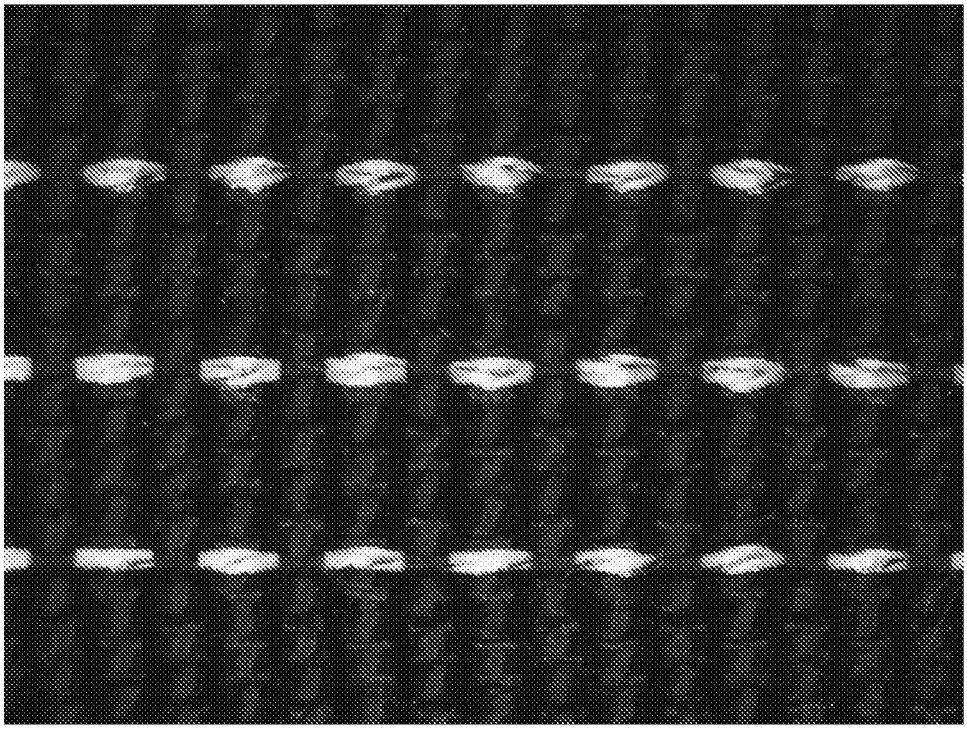
FIG. 10 is a photograph showing braided composite yarns of the present invention woven into a fabric.

FIG. 10 shows a woven fabric with three horizontal braided composite yarns selectively woven as weft yarns for use as data, power, and ground lines in the formation of textile-integrated circuits.

Example 8

Multifunctional multi-material braided composite yarns have been constructed for applications requiring both resistive joule heating and capacitive proximity sensing. The braided composite yarn was constructed using three multicomponent bundles, where two bundles each comprised one Tex 21 bonded Kevlar® yarn and one insulated 44AWG Cu55Ni45 alloy wire. The remaining multicomponent bundle comprised one Tex 21 bonded Kevlar® yarn and one insulated 44AWG copper conductor. The 44AWG Cu55Ni45 alloy wires were soldered together at one terminating end of the braided composite yarn using flux and $Sn_{96.5}Ag_{3.5}$ solder, thus enabling connection to the appropriate circuitry for resistive joule heating at the remaining terminating ends, forming a complete electrical circuit. The remaining 44AWG copper conductor was terminated to the appropriate circuitry at this same end of the braided composite yarn for use as a capacitive sensor for switching or other applications.

Example 9

Braided composite yarns with a 0.003" diameter superelastic Nitinol core have been constructed to form strain sensors. The yarn comprised three Tex 21 Kevlar® yarns and one multicomponent bundle comprising one Tex 21 bonded Kevlar® yarn and one 44AWG insulated conductor braided together around the Nitinol core. The Nitinol core was soldered to the 44AWG conductor at one terminating end of the braided composite yarn using flux and $Sn_{96.5}Ag_{3.5}$ solder. The electrical resistance between the remaining terminating ends of the Nitinol core and 44AWG insulated conductor was measured by the appropriate circuitry. The Tex 21 Kevlar® structural components and braid angle were chosen such that the maximum elongation of the braided composite yarn was no greater than 8%, to ensure consistent strain-resistance sensing response of the Nitinol core over its life. As the braided composite yarn elongated up to its mechanical limit of 8%, it demonstrated a predictable change in electrical resistance, thus exhibiting suitability for use as a strain sensor.

Note that in the specification and claims, "about" or "approximately" means within twenty percent (20%) of the numerical amount cited. As used herein, the singular forms "a," "an," and "the" include plural referents unless the context clearly dictates otherwise. Thus, for example, reference to "a functional group" refers to one or more functional groups, and reference to "the method" includes reference to equivalent steps and methods that would be understood and appreciated by those skilled in the art, and so forth.

Although the invention has been described in detail with particular reference to the disclosed embodiments, other embodiments can achieve the same results. Variations and modifications of the present invention will be obvious to those skilled in the art and it is intended to cover all such modifications and equivalents. The entire disclosures of all patents and publications cited above are hereby incorporated by reference.

What is claimed is:

1. A braided composite yarn comprising one or more multicomponent fiber bundles, each said one or more multicomponent fiber bundle comprising one or more functional components comprising a conductor coated with insulation and at least one structural component.

2. The braided composite yarn of claim 1 wherein said conductor comprises 44AWG copper wire insulated with layered polyurethane and/or polyamide insulation.

3. The braided composite yarn of claim 1 wherein said conductor comprises a material with a sufficiently high resistivity and sufficiently low temperature coefficient of resistance to be suitable for resistive joule heating.

4. The braided composite yarn of claim 1 wherein at least one of said one or more functional components comprises a material selected from the group consisting of plastic, glass, fiber optic material, nickel-titanium alloy, nickel-chrome alloy, extruded conductive polymer, conductive yarn, and piezoelectric yarn.

5. The braided composite yarn of claim 4 wherein said material comprises an additive, coating, or plating to modify its electrical, mechanical, optical, surface, visual, or other properties.

6. The braided composite yarn of claim 1 wherein said at least one structural component comprises a material selected from the group consisting of synthetic, natural, bonded para-aramid, meta-aramid, silica, quartz, nylon, polyester, cotton, and wool.

7. The braided composite yarn of claim 1 wherein a maximum elongation at break of said at least one structural component is less than an elastic limit of said one or more functional components.

8. The braided composite yarn of claim 7 wherein said maximum elongation at break is approximately less than 10%.

9. The braided composite yarn of claim 1 wherein said at least one structural component flattens when the braided composite yarn is under tension.

10. The braided composite yarn of claim 1 wherein said one or more multicomponent fiber bundles are braided together with additional structural components.

11. The braided composite yarn of claim 1 wherein said one or more functional components are accessible at the surface of the braided composite yarn.

12. The braided composite yarn of claim 1 configured to form at least a portion of one or more electronic or electromagnetic devices.

13. The braided composite yarn of claim 12 wherein each said device is selected from the group consisting of inductor, capacitor, antenna, collapsible antenna structure, transmission line, inter-integrated circuit ($I^2C$) network, data network, serial data bus, ethernet network, power network, active heating element, power line, electromagnet, choke, transformer, sensor, capacitive touch sensor, strain sensor, distributed sensor network, sensor array, and filter.

14. The braided composite yarn of claim 1 where said one or more functional components of one of said one or more multicomponent fiber bundles comprise two conductors which form a twisted pair transmission line.

15. The braided composite yarn of claim 1 comprising a core.

16. The braided composite yarn of claim 15 wherein said core has one or more properties selected from the group consisting of solid, hollow, conducting, dielectric, insulating, ferromagnetic, superelastic, shape memory, and para-aramid.

17. The braided composite yarn of claim 15 wherein said core limits deformation of the braided composite yarn under tension.

18. A method of using the braided composite yarn of claim 1, the method comprising incorporating the braided composite yarn into an active textile.

19. The method of claim 18 comprising sewing the braided composite yarn onto the active textile.

20. The method of claim 19 wherein the sewing step comprises attaching the braided composite yarn to the active textile using straight sewn stitches produced using a top thread with the braided composite yarn loaded in a bobbin mechanism of a sewing or embroidery machine.

21. The method of claim 20 wherein the top thread is an aramid thread.

22. The method of claim 20 wherein the stitches are periodic, thereby forming mechanically isolated subdomains of the braided composite yarn.

23. The method of claim 22 wherein adjacent stitches are spaced approximately between 1 mm and 2 mm.

24. The method of claim 18 comprising weaving the braided composite yarn into the warp or weft of the active textile.

25. The method of claim 18 comprising directly soldering the braided composite yarn to an electronic component or printed circuit board (PCB) through-hole attached to the active textile.

26. The method of claim 25 comprising removing insulation from at least one of the one or more functional components using heat from a soldering device.

27. The method of claim 25 wherein stripping the insulation from the at least one functional component prior to soldering is not required.

28. The method of claim 25 wherein the at least one structural component has a higher decomposition temperature than a soldering temperature.

29. The method of claim 25 comprising encapsulating the electronic component directly to the active textile using epoxy potting compound.

30. The method of claim 18 comprising routing the braided composite yarn using computer aided design (CAD) and the incorporating step comprises CNC embroidery, tailored fiber placement, or using a CNC machine.

31. A method of manufacturing a braided composite yarn, the method comprising:

winding in parallel one or more functional components comprising a conductor coated with insulation and at least one structural component to form a first multicomponent fiber bundle; and braiding the first multicomponent fiber bundle with a second multicomponent fiber bundle and/or a structural component.

32. The method of claim 31 wherein the winding step comprises winding the multicomponent fiber bundle onto a single braider bobbin.

33. The method of claim 31 wherein the winding step is performed under tension.

34. The method of claim 31 wherein the braiding step comprises loading a first braider bobbin comprising the first multicomponent fiber bundle and a second braider bobbin comprising a second multicomponent fiber bundle or a structural component in a braiding machine.

35. The method of claim 34 wherein the braiding machine is in a balanced quarter-carrier configuration.

36. The method of claim 31 wherein the braiding step comprises incorporating a core in the braided composite yarn.

* * * * *